US006910958B2

(12) United States Patent
Chen et al.

(10) Patent No.: US 6,910,958 B2
(45) Date of Patent: Jun. 28, 2005

(54) FEEDING MECHANISM OF A RIPPLED EDGE BEVELER

(75) Inventors: Xiqing Chen, Zhongshan (CN); Junhui Huang, Zhongshan (CN); Changchun Zhou, Zhongshan (CN)

(73) Assignee: Zhongshan Fushan Glass Machinery Co., Ltd., Guangdong (CN)

( * ) Notice: Subject to any disclaimer, the term of this patent is extended or adjusted under 35 U.S.C. 154(b) by 755 days.

(21) Appl. No.: 09/794,311

(22) Filed: Feb. 27, 2001

(65) Prior Publication Data

US 2002/0005049 A1 Jan. 17, 2002

(30) Foreign Application Priority Data

Jul. 11, 2000 (CN) ..... 00228847 U

(51) Int. Cl.[7] ..... B24B 9/10
(52) U.S. Cl. ..... 451/150; 451/121; 451/44
(58) Field of Search ..... 451/120, 150, 451/124, 140, 157, 44

(56) References Cited

U.S. PATENT DOCUMENTS 4,617,760 A * 10/1986 Nagata ..... 451/150
6,001,003 A * 12/1999 Park ..... 451/157

FOREIGN PATENT DOCUMENTS

GB 000004522 * 4/1885 ..... 451/150
GB 000533246 * 2/1941 ..... 451/150

* cited by examiner

*Primary Examiner*—Robert A. Rose
(74) *Attorney, Agent, or Firm*—Patterson, Thuente, Skaar & Christensen, P.A.

(57) ABSTRACT

The present invention relates to a rippled edge beveler comprising a wheelhead feeding mechanism having an upper planker and a grinding wheel, wherein the upper planker 2 is connected to the middle planker which is connected to the lower planker fixed on the grinding wheel beam. A drive motor is joined to the lower part of the grinding wheel beam, the drive motor connected to a driving gear which engages the middle gear. The spin axis is connected to the middle gear. Several driven gears are joined to the middle of the spin axis. The driven gears are connected to the input end of the worm screw decelerator, whose output end is connected to the vertical shaft, whose end is connected to the middle planker. The present structure is reliable to use, convenient and easy to install and pleasing to the eye.

3 Claims, 4 Drawing Sheets

FEEDING MECHANISM OF A RIPPLED EDGE BEVELER

CROSS-REFERENCE TO RELATED PATENT APPLICATION

This application claims priority to Chinese Patent Application No. 00228847.8, entitled, "A Feeding Mechanism of a Rippled Edge Beveler," as filed on Jul. 11, 2000, the entire contents of which incorporated herein by reference.

FIELD OF THE INVENTION

The present invention relates to a core component of the rippled edge beveler, which is a new invention in the field of the deep-processing of glass. It is applicable to the grinding and processing of straight underplates, edges, rippled edges and bevel edges, and it falls into the category of glass edge grinding machinery.

BACKGROUND OF THE INVENTION

Among the variety of glass edge grinding machines in the field of deep processing of glass, the most popularly used one is the type of straight edge beveler. Such equipment, when processing the glass, advances horizontally at an even speed and the wheelhead on the grinding wheel beam remains motionless (with only the grinding wheel rotating at a high speed), thus beveling the underside and the other sides of the glass and forming a horizontal chamfer or a slant. Because of the limitation of equipment of this type, rippled edge cutting cannot be achieved on the front side of the glass and there will be no catchy curvaceous waves, which impedes the diversity and aesthetic quality of the glassware on all its sides. Based on the above reasons, a new beveling machine that can process rippled line on glass is expected.

The present invention provides a feeding mechanism of a rippled edge beveler. The addition of such structure adds a new function to the conventional straight edge beveler and enables it to cut rippled edges, thus greatly enhancing the appeal of the glassware and its color variety, widening its applicability and thus being in conformity to the needs of modern fashion architectural design and people's everyday life.

The technical consideration of the present invention is to add to the conventional straight edge beveler, which can both grind and cut the bevel edges and the underside of the glassware, an additional structure to make the wheelhead move backward and forward regularly. The grinding wheel of the wheelhead grinds and cuts the bevel edge of the glass during its backward-and-forward motion, thus making cambers of different depths on the surface of the glass, which, when looked from the front side, are rippled fringes, the outline of the cambers being half sinusoid. Half sinusoids of different wavelengths can be obtained by adjusting the speed of the movement of the glass and the frequency of reciprocal movement of the grinding wheel. Once the wavelength is set, rippled fringes can be obtained. The new structure according to the present invention makes possible the application of a new type of deflashing machine which can process not only straight bevels but also rippled fringes.

SUMMARY OF THE INVENTION

According to the invention, there is provided a wheelhead feeding mechanism of a rippled edge beveler having an oblong upper planker, a lead screw, an adjusting wheel, a wheelhead motor and a wheelhead, comprising the upper planker being superimposed on a medial planker, which in turn is superimposed on a lower planker; the lower planker being superimposed on the beam of the grinding wheel; a drive motor being joined to the lower part of the grinding wheel beam; a drive motor being connected to a driving gear which engages a middle gear; a thread-like spin axis being connected to the middle gear at its end; several driven gears being joined to the middle of the spin axis at regular intervals; the driven gears being connected to the input axis of a worm screw decelerator whose output end is joined with a vertical shaft; a cam being located at the upper end of the vertical shaft, which is engaged with a recess in the middle planker.

Preferably, the spin axis is fixed on the bracing frames under the beam of the grinding wheel; five to twelve worm screw decelerators are joined to the spin axis and five to twelve worm screw decelerators are in turn connected to five to twelve vertical shafts.

The present invention has many advantages. The first advantage is its multi-applicabilities. It can be used to cut not only straight bevel out of plate glass but also rippled fringes. The second advantage is that it has a novel and reasonable structure and works reliably. The third advantage of the present invention is that it can process fringes of different wavelengths, ranging from 28.6 millimeters to 117 millimeters, and these lengths can be adjusted freely.

BRIEF DESCRIPTION OF THE DRAWINGS

Following is an illustration of the structure according to the present invention and its working principle with reference to the accompanying drawings.

DETAILED DESCRIPTION OF THE PREFERRED EMBODIMENTS

Figure 1:
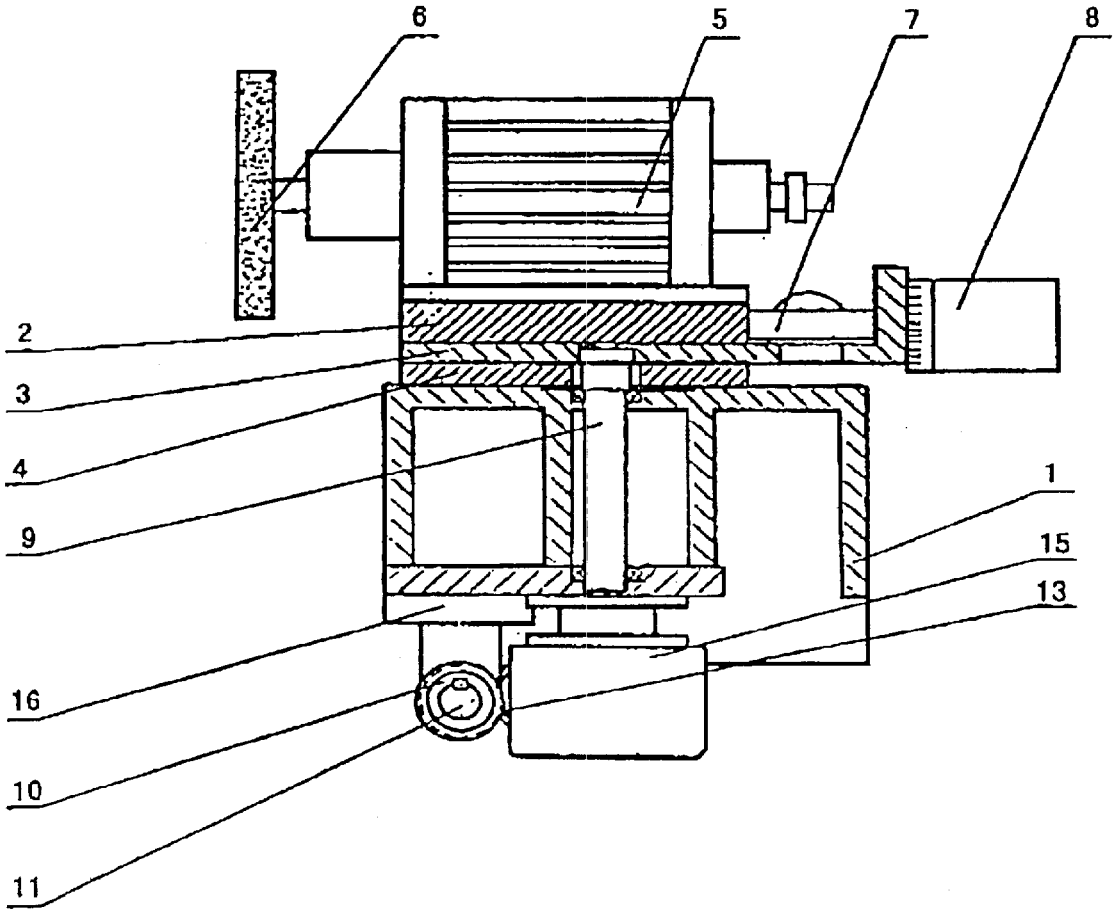
FIG. 1 is a cutaway view of the present invention seen from the front side.
Figure 2:
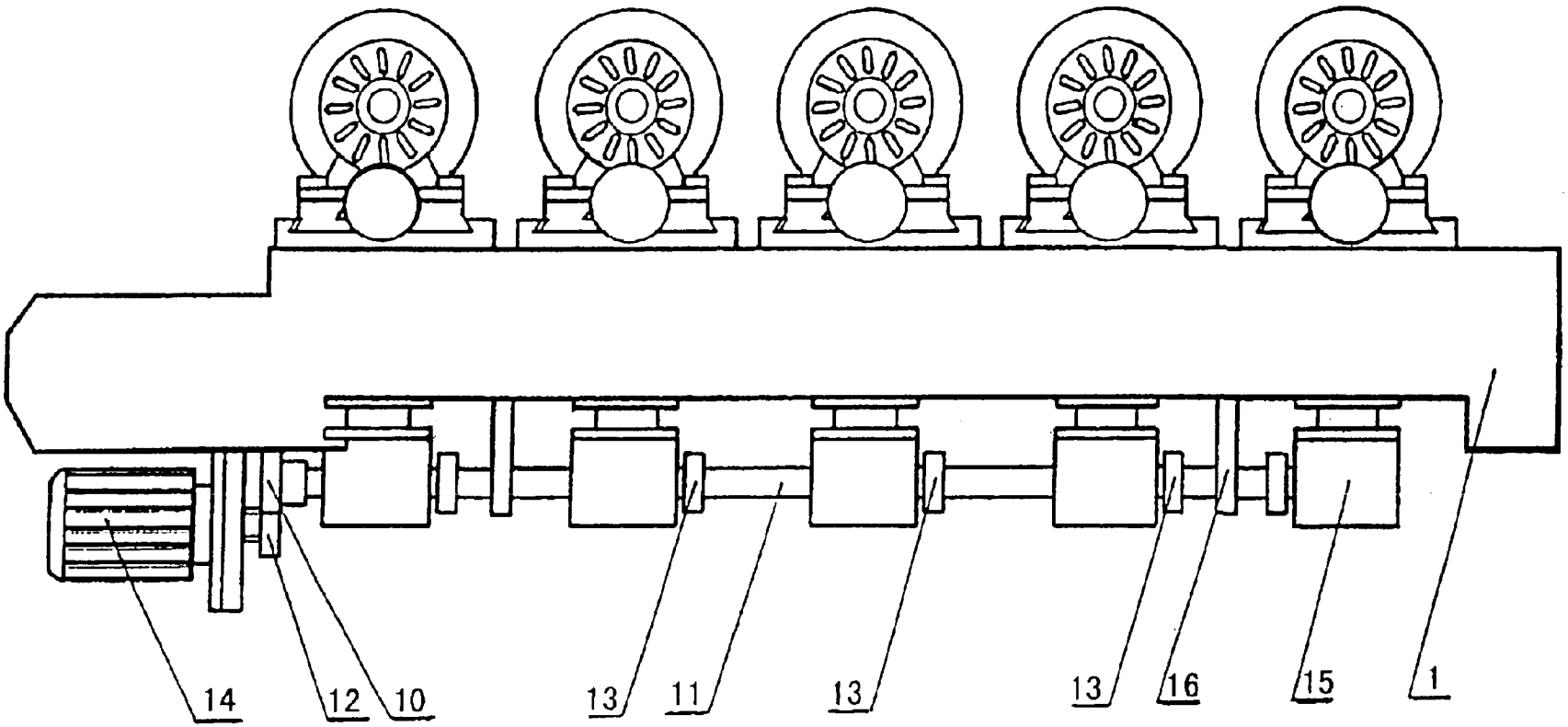
FIG. 2 shows the different combinations of the present invention seen from the left.
Figure 3:
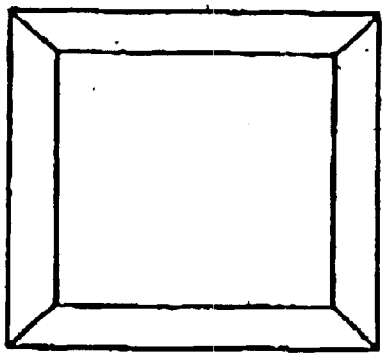
FIG. 3 is a front view of the glass product processed and ground by a straight line beveler.
Figure 4:
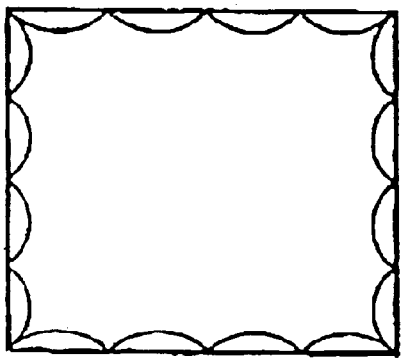
FIGS. 4–7, respectively, provide a front view of the glass product processed through use of the present invention.
Figure 5:
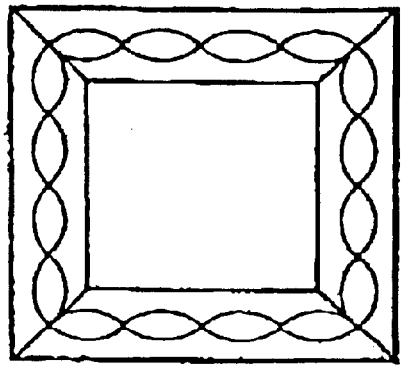
Figure 6:
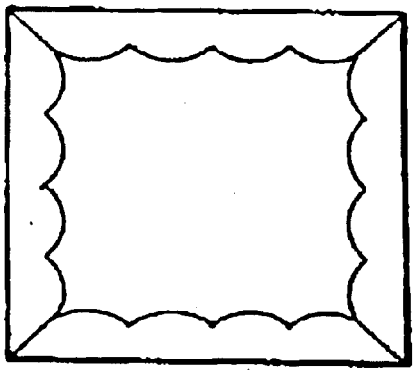
Figure 7:
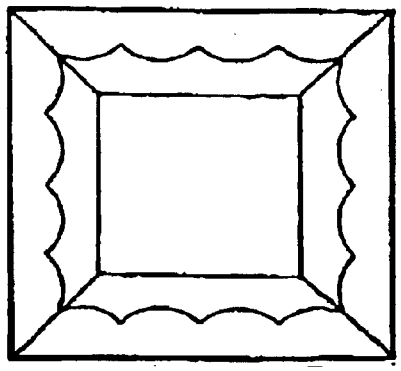

As shown in FIGS. 1 and 2, a wheelhead feeding mechanism of the rippled edge beveler consists of an oblong upper planker 2, a lead screw 7, an adjusting wheel 8, a wheelhead motor 5 and a wheelhead 6, and so on. The first structural feature of the present invention is that the upper planker 2 is superimposed on the medial planker 3, which in turn is superimposed on a lower planker 4. The lower planker 4 is superimposed on the beam 1 of the grinding wheel, at the bottom of which is connected to a drive motor 14, which is connected to a driving gear 12, the driving gear 12 engaging the middle gear 10. One end of the thread-like spin axis 11 is connected to the middle gear 10. Several driven gears 13 are joined to the middle of the spin axis 11 at regular intervals, the driven gears 13 are connected to the input axis of the worm screw decelerator 15, whose output end is joined with the vertical shaft 9, the vertical shaft 9 is provided with a cam 17 at its upper end, the cam 17 is engaged with a recess in the middle planker 3. The second feature of the present invention is that the spin axis 11 is connected to the bracing frames 16 under the beam 1 of the grinding wheel, and five to twelve worm screw decelerators 15 are connected to the spin axis 11, which are in turn connected to five to twelve vertical shafts 9.

Figure 8:
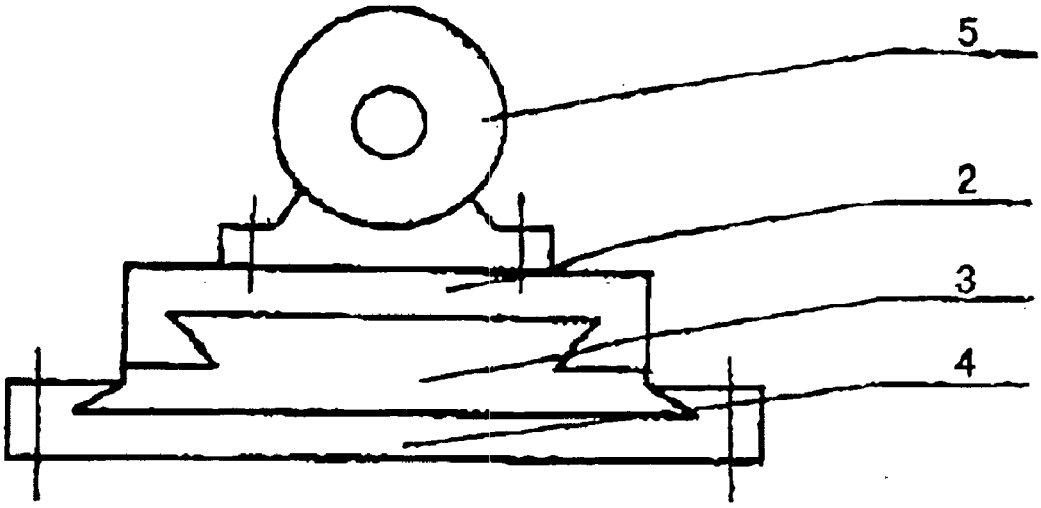
FIG. 8 is a schematic view showing the upper planker, the medial planker and the lower planer superimposed.
Figure 9:
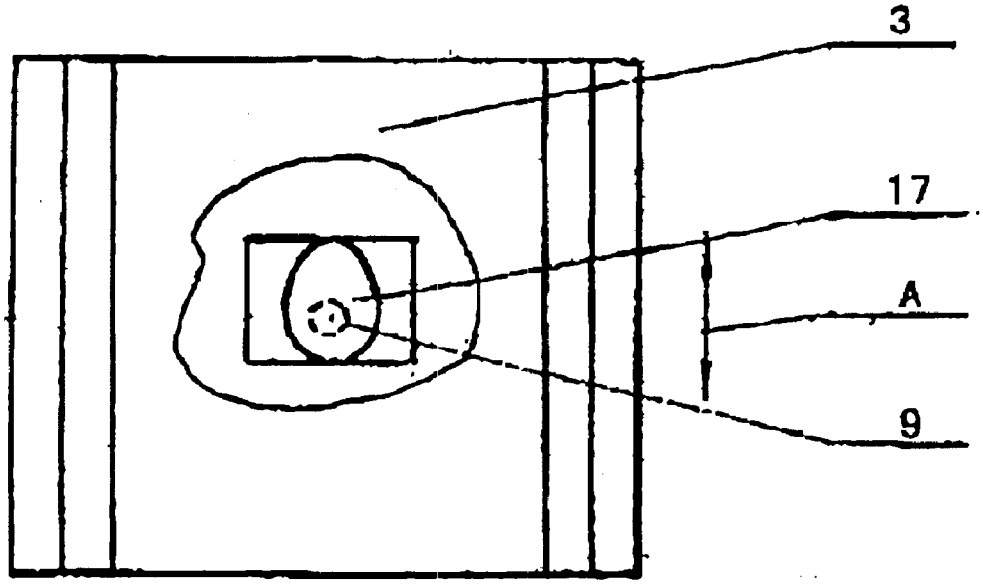
FIG. 9 is a schematic view showing the cam within the rectangular recess in the medial planker.

FIG. 8 is a schematic view showing the upper planker 2, the medial planker 3 and the lower planker 4 superimposed, and FIG. 9 is a schematic view showing the cam within the rectangular recess in the medial planker 3. As shown in FIGS. 8 and 9, the upper planker 2, the medial planker 3 and the lower planker 4 are superimposed one another in a dovetail groove manner. The lower planker 4 is immovably fixed on the beam 1 of the grinding wheel. The medial planker 3 is engaged with the lower planker 4. The medial planker 3 is provided with a rectangular recess in its middle part. The rectangular recess is adapted to a cam 17 connected to the vertical shaft 9. The cam 17 will rotate in the recess with the vertical shaft 9 rotated, thus making the medial planker 3 move backward and forward regularly as shown in the direction of arrow A. The medial planker 3 moves backward and forward once when the cam 17 is rotated in one circle. The lead screw 7 and the adjusting wheel 8 can adjust the position of the upper planker 2 relative to the medial planker 3 so as to decide different feeding value according to the cutting depth to the glass.

The working principle of the present invention is described as follows:

When a glass product needs cutting and grinding, its length and width are first measured, then the wavelength of each is set. The product of the wavelength multiplied by the amount of the wavelength is exactly the length or the width, that is, either the length or the width of the glass should be the multiple of the wavelength. Glass processed like this has a good diagonal symmetry. When the moving speed of the glass is selected, the frequency of the reciprocal motion of the wheelhead motor will be calculated and accordingly adjusted, and the drive motor will then be started. The high-speed backward-and-forward movement of the grinding wheel (200 revolutions per minute) will cut out cambers of different depths on the bevel of the glass. When seen from the front, the outline of the camber is a half sinusoid, which when joined together, forms a delicate rippled fringe. FIG. 2 shows the working principle of the present invention. The driving gear on the drive motor drives the driven gear, which drives the worm screw and the worm wheel. The worm gear case causes the vertical shaft to rotate. The cam at the upper end of the vertical shaft starts to rotate, making the medial planker move to and from along the track of the dovetail groove, thus driving the upper planker and the grinding wheel on the wheelhead to move backwards and forwards.

What is claimed is:

1. A wheelhead feeding mechanism of a rippled edge beveler having an oblong upper planker, a medial planker, a lead screw, an adjusting wheel, a wheelhead motor, and a wheelhead, comprising:

said upper planker superimposed on the medial planker, which in turn is superimposed on a lower planker;

said lower planker superimposed on a beam of a grinding wheel;

a drive motor joined to a lower part of the grinding wheel beam;

said drive motor connected to a driving gear which engages a middle gear;

a thread-shaped spin axis connected to the middle gear at an end of the thread-shaped spin axis;

a plurality of driven gears joined to a middle part of the spin axis at regular intervals;

said driven gears connected to the input axis of a worm screw decelerator having an output end that is joined with a vertical shaft; and a cam located at the upper end of the vertical shaft, which is engaged with a recess in the medial planker.

2. A wheelhead feeding mechanism of a rippled edge beveler according to claim 1, comprising a plurality of worm screw decelerators, each having an output end that is joined with one of a plurality of vertical shafts.

3. A wheelband feeding mechanism of a rippled edge beveler according to claim 2, wherein said spin axis is fixed on a bracing frame under the beam of the grinding wheel; not less than five to not more than twelve worm screw decelerators are joined to the spin axis, and said not less than five to not more than twelve worm screw decelerators are in turn connected to not less than five to not more than twelve vertical shafts.

* * * * *